US008544973B2

(12) United States Patent
Kwon et al.

(10) Patent No.: US 8,544,973 B2
(45) Date of Patent: Oct. 1, 2013

(54) REFRIGERATOR

(75) Inventors: Hong Sik Kwon, Seoul (KR); Yong Hun Chang, Seoul (KR); Jung Yeon Hwang, Seoul (KR); Seon Il Yu, Seoul (KR)

(73) Assignee: LG Electronics Inc., Seoul (KR)

( * ) Notice: Subject to any disclaimer, the term of this patent is extended or adjusted under 35 U.S.C. 154(b) by 232 days.

(21) Appl. No.: 12/792,601

(22) Filed: Jun. 2, 2010

(65) Prior Publication Data

US 2010/0307188 A1 Dec. 9, 2010

(30) Foreign Application Priority Data

Jun. 3, 2009 (KR) ..... 10-2009-0049240

(51) Int. Cl.

| | |
|---|---|
| ***A47B 96/04*** | (2006.01) |
| ***A47B 88/00*** | (2006.01) |
| ***A47B 49/00*** | (2006.01) |
| ***A47B 81/00*** | (2006.01) |
| ***A47B 97/00*** | (2006.01) |
| ***E06B 1/00*** | (2006.01) |

(52) U.S. Cl.

USPC ..... 312/405.1; 312/311; 312/326; 312/273; 312/321.5

(58) Field of Classification Search

USPC ..... 312/271, 273, 275, 405, 405.1, 311, 312/313, 315, 326, 321.5; 16/362, 363, 365, 16/366

See application file for complete search history.

(56) References Cited

U.S. PATENT DOCUMENTS

| | | | | | |
|---|---|---|---|---|---|
| 276,267 | A | * | 4/1883 | Moon | 40/530 |
| 1,275,511 | A | * | 8/1918 | Welch | 312/292 |
| 1,927,398 | A | | 9/1933 | Glasser | |
| 1,984,977 | A | * | 12/1934 | Mize | 312/276 |
| 2,039,130 | A | | 4/1936 | Note | |
| 2,046,909 | A | * | 7/1936 | Terry et al. | 312/300 |

(Continued)

FOREIGN PATENT DOCUMENTS

| | | | |
|---|---|---|---|
| CN | 2429800 | Y | 5/2001 |
| CN | 1627016 | A | 6/2005 |

(Continued)

OTHER PUBLICATIONS

PCT International Search Report dated Dec. 20, 2010 for Application No. PCT/KR2010/003542, 3 pages.

(Continued)

*Primary Examiner* — Darnell Jayne
*Assistant Examiner* — Kimberley S Wright
(74) *Attorney, Agent, or Firm* — Fish & Richardson P.C.

(57) ABSTRACT

A refrigerator is disclosed. The refrigerator includes a cabinet configured to define an exterior boundary of the refrigerator. The refrigerator also includes a first storage chamber defined by interior walls of the cabinet and configured to store food stuffs. The refrigerator further includes a first door configured to open and close the first storage chamber by rotating about a rotational axis. In addition, the refrigerator includes a second storage chamber that is smaller than the first storage chamber defined at a side of the first door, and that is configured to enable access to food stuffs while the first door remains closed and a second door, located in a predetermined portion of the first door, configured to open and close the second storage chamber by rotating the rotational axis, wherein a rotation direction of the second door is identical to the rotation direction of the first door.

9 Claims, 7 Drawing Sheets

(56) References Cited

U.S. PATENT DOCUMENTS

| | | | | | |
|---|---|---|---|---|---|
| 2,062,360 | A | * | 12/1936 | Goulooze | 312/275 |
| 2,095,811 | A | * | 10/1937 | Goulooze | 312/274 |
| 2,112,771 | A | * | 3/1938 | Goulooze | 312/275 |
| 2,129,923 | A | * | 9/1938 | Frankel | 312/236 |
| 2,131,680 | A | * | 9/1938 | Zahodiakin | 62/266 |
| 2,150,064 | A | * | 3/1939 | John et al. | 62/266 |
| 2,281,430 | A | * | 4/1942 | Grant | 312/292 |
| 2,385,169 | A | * | 9/1945 | Stone | 16/390 |
| 2,510,827 | A | * | 6/1950 | McDonald | 16/365 |
| 2,653,851 | A | | 9/1953 | Davidson | |
| 2,656,688 | A | * | 10/1953 | Hinkel | 62/441 |
| 2,692,813 | A | | 10/1954 | Toronto | |
| 2,945,733 | A | | 7/1960 | Malia | |
| 3,086,830 | A | | 4/1963 | Peter | |
| 3,140,134 | A | | 7/1964 | Nairn | |
| 3,218,111 | A | * | 11/1965 | Steiner | 312/405.1 |
| 3,299,573 | A | * | 1/1967 | Gustafson | 49/388 |
| 3,389,424 | A | * | 6/1968 | Fellwock | 16/392 |
| 3,395,423 | A | * | 8/1968 | Bus | 16/262 |
| 3,510,986 | A | * | 5/1970 | Berkowitz | 49/386 |
| 3,619,853 | A | * | 11/1971 | Merrill | 16/366 |
| 3,643,464 | A | * | 2/1972 | Hilliker et al. | 62/344 |
| 3,766,599 | A | * | 10/1973 | Ullman, Jr. | 16/257 |
| 3,874,027 | A | * | 4/1975 | Parsons | 16/221 |
| 3,883,204 | A | * | 5/1975 | Prada et al. | 312/273 |
| 3,909,091 | A | * | 9/1975 | Tantillo | 312/224 |
| 4,084,291 | A | * | 4/1978 | Crowe | 16/262 |
| 4,087,140 | A | * | 5/1978 | Linstromberg | 312/292 |
| 4,133,143 | A | * | 1/1979 | Campisano | 49/388 |
| 4,269,039 | A | * | 5/1981 | Baker | 62/344 |
| 4,302,907 | A | * | 12/1981 | Canals et al. | 49/65 |
| 4,368,557 | A | * | 1/1983 | Inasawa et al. | 16/263 |
| 4,368,622 | A | * | 1/1983 | Brooks | 62/157 |
| 4,423,563 | A | * | 1/1984 | Ondricek | 40/533 |
| 4,503,583 | A | * | 3/1985 | Frohbieter | 16/232 |
| 4,514,021 | A | * | 4/1985 | Sundermeier et al. | 312/291 |
| 4,586,347 | A | * | 5/1986 | McCarty | 62/265 |
| 5,209,082 | A | * | 5/1993 | Ha | 62/265 |
| 5,458,412 | A | | 10/1995 | Lee et al. | |
| 5,675,944 | A | | 10/1997 | Kerr et al. | |
| 5,966,963 | A | * | 10/1999 | Kovalaske | 62/441 |
| 6,055,823 | A | * | 5/2000 | Baker et al. | 62/265 |
| 6,056,378 | A | * | 5/2000 | Semon et al. | 312/246 |
| 6,164,645 | A | * | 12/2000 | Weiss | 273/138.2 |
| 6,268,594 | B1 | | 7/2001 | Leutner et al. | |
| 6,349,999 | B1 | * | 2/2002 | Takahashi et al. | 312/209 |
| 6,375,291 | B1 | | 4/2002 | Nam et al. | |
| 6,547,349 | B2 | * | 4/2003 | Sessa et al. | 312/352 |
| D508,249 | S | * | 8/2005 | Seok et al. | D15/86 |
| 6,938,665 | B2 | * | 9/2005 | Lewis et al. | 160/96 |
| D527,398 | S | * | 8/2006 | Kim et al. | D15/86 |
| 7,198,340 | B1 | * | 4/2007 | Ertz | 312/408 |
| 7,254,958 | B2 | * | 8/2007 | Kim et al. | 62/265 |
| 7,784,219 | B2 | * | 8/2010 | Yoshikawa et al. | 49/379 |
| D629,021 | S | * | 12/2010 | Cho et al. | D15/85 |
| 2002/0093276 | A1 | * | 7/2002 | Kawakami | 312/405 |
| 2005/0188506 | A1 | | 9/2005 | Lee et al. | |
| 2005/0258724 | A1 | | 11/2005 | Hwa | |
| 2006/0005484 | A1 | | 1/2006 | Riblier et al. | |
| 2006/0150661 | A1 | | 7/2006 | Kim et al. | |
| 2006/0265979 | A1 | | 11/2006 | Cording | |
| 2007/0018548 | A1 | | 1/2007 | Ertz et al. | |
| 2009/0139260 | A1 | * | 6/2009 | Yoshikawa et al. | 62/449 |
| 2009/0273264 | A1 | * | 11/2009 | Butler | 312/405 |
| 2010/0107679 | A1 | | 5/2010 | Park et al. | |
| 2010/0170279 | A1 | * | 7/2010 | Aoki | 62/264 |
| 2010/0307186 | A1 | * | 12/2010 | Kwon et al. | 62/407 |
| 2011/0023527 | A1 | * | 2/2011 | Kwon et al. | 62/441 |
| 2011/0023528 | A1 | * | 2/2011 | Kwon et al. | 62/441 |
| 2011/0146323 | A1 | * | 6/2011 | Choi | 62/340 |
| 2011/0232317 | A1 | * | 9/2011 | Flores | 62/320 |
| 2011/0232323 | A1 | * | 9/2011 | Morris | 62/457.9 |

FOREIGN PATENT DOCUMENTS

| | | | | |
|---|---|---|---|---|
| CN | 1627016 | A | | 6/2008 |
| EP | 0 539 558 | A1 | | 12/1992 |
| EP | 1403415 | A2 | | 3/2004 |
| EP | 1683903 | A1 | | 7/2006 |
| ES | EP 0539558 | | * | 11/1992 |
| JP | 56-164495 | U | | 12/1981 |
| JP | 63-142682 | U | | 9/1988 |
| JP | 06-066473 | A | | 3/1994 |
| JP | 10-009757 | A | | 1/1998 |
| JP | 2000-065459 | A | | 3/2000 |
| JP | 2001-108357 | A | | 4/2001 |
| JP | 2002-323287 | A | | 11/2002 |
| JP | 2006-038437 | A | | 2/2006 |
| JP | 2009-103395 | A | | 5/2009 |
| KR | 20-19900008203 | Y1 | | 3/1990 |
| KR | 1990-0008203 | Y1 | | 9/1990 |
| KR | 20-19960008835 | U | | 3/1996 |
| KR | 1996-0011364 | A | | 4/1996 |
| KR | 10-19970007503 | B1 | | 5/1997 |
| KR | 1999-011033 | U | | 3/1999 |
| KR | 1999-042339 | A | | 6/1999 |
| KR | 1999-0042339 | A | | 6/1999 |
| KR | 1999-0049554 | A | | 7/1999 |
| KR | 1999-062159 | A | | 7/1999 |
| KR | 10-1999074448 | A | | 10/1999 |
| KR | 1999-037440 | A | | 10/1999 |
| KR | 1999-0039593 | A | | 11/1999 |
| KR | 20-0164322 | Y1 | | 2/2000 |
| KR | 20-0168373 | Y1 | | 2/2000 |
| KR | 20-0183300 | Y1 | | 5/2000 |
| KR | 2002-0083115 | A | | 11/2002 |
| KR | 10-0376167 | B | | 3/2003 |
| KR | 10-0376167 | B1 | | 3/2003 |
| KR | 20-0314145 | Y1 | | 5/2003 |
| KR | 2003-0083813 | A | | 11/2003 |
| KR | 10-20050111094 | A | | 11/2005 |
| KR | 2005-0111094 | A | | 11/2005 |
| KR | 10-0596533 | B1 | | 7/2006 |
| KR | 10-0733309 | B1 | | 6/2007 |
| KR | 10-0887575 | B1 | | 3/2009 |
| KR | 10-20090077564 | A | | 7/2009 |
| KR | 2009-0077564 | A | | 7/2009 |

OTHER PUBLICATIONS

PCT International Search Report dated Dec. 23, 2010 for Application No. PCT/KR2010/003616, 3 pages.

PCT International Search Report dated Dec. 23, 2010 for Application No. PCT/KR2010/003617, 3 pages.

US Office Action dated Jun. 21, 2012 for U.S. Appl. No. 12/835,775, 16 pages.

US Notice of Allowance dated Oct. 11, 2012 for U.S. Appl. No. 12/834,919, 12 pages.

Russian Office Action dated Nov. 14, 2012 for Application No. 2011144142, with English translation, 5 pages.

European Office Action dated May 6, 2013 for Application No. 07834336.5, 7 pages.

Chinese Office Action dated May 27, 2013 for Application No. 201080020356.1, with English Translation, 20 pages.

* cited by examiner

REFRIGERATOR

CROSS REFERENCE TO RELATED APPLICATION

This application claims the benefit of priority to Korean Application No. 10-2009-0049240, filed on Jun. 3, 2009, which is hereby expressly incorporated by reference in its entirely.

FIELD

The present disclosure relates to a refrigerator structure.

BACKGROUND

Refrigerators have at least one storage chamber for storing food stuffs and the storage chambers are selectively closed by doors. In general, such a storage chamber may be classified into a freezer chamber and a refrigerator chamber, and refrigerators may be classified into several types based on freezer/refrigerator chamber arrangement, door appearance or door closing structure.

Typically, a predetermined space for preserving food stuffs is defined by a door. For example, a door basket having a predetermined space is provided in the door to preserve food stuffs contained in relatively tall containers, for example, bottles. A user opens the door to put or take the food stuffs into or out of the door basket defined the door. That is, the door basket is accessible from an inner side of the door. Another type of food storage space provided in the door is a storage chamber commonly called as a home bar. Such the storage chamber, namely, a home bar is in the door and it is accessible from an outer side of the door via an auxiliary door additionally provided in the door. That is, without opening the door, the user opens the auxiliary door to put or take in or out food stuffs provided in the door storage chamber.

The conventional refrigerator may have limitation of enlarging the size of the door storage chamber. Also, the conventional refrigerator may have a relatively complicated coupling structure of an auxiliary door coupled to the door to open and close the door storage chamber.

SUMMARY

In one aspect, a refrigerator includes a cabinet configured to define an exterior boundary of the refrigerator. The refrigerator also includes a first storage chamber defined by interior walls of the cabinet and configured to store food stuffs. The refrigerator further includes a first door configured to open and close the first storage chamber by rotating about a rotational axis. In addition, the refrigerator includes a second storage chamber that is smaller than the first storage chamber defined at a side of the first door, and that is configured to enable access to food stuffs while the first door remains closed and a second door, located in a predetermined portion of the first door, configured to open and close the second storage chamber by rotating the rotational axis, wherein a rotation direction of the second door is identical to the rotation direction of the first door.

Implementations may include one or more of the following features. For example, the refrigerator further includes a rotational shaft coupled to the first door and the second door to establish the rotational axis. The rotational shaft includes an upper rotational shaft that is coupled to the first door and the second door. The refrigerator further includes a first rotational shaft coupled to the first door and a second rotational shaft coupled to the second door, wherein the first rotational shaft and the second rotational shaft establish the rotational axis.

In some examples, the refrigerator of claim further includes a first connection member configured to connect the rotational shaft to the cabinet. The refrigerator further includes a second connection member configured to connect the rotational shaft to the first door. The refrigerator further includes a securing part stepped toward the cabinet and configure to secure the second door.

The refrigerator further includes a freezer chamber located below the first storage chamber and a third door configured to open and close the freezer chamber. The second storage chamber comprises a home bar. The first door includes a recess configured to be used as a door handle. The second door includes a recess configured to be used as a door handle. A width of the second door is substantially identical to a width of the first door.

In another aspect, a refrigerator includes a cabinet configured to define an exterior boundary of the refrigerator with at least one opening therein. The refrigerator also includes a first storage chamber defined by interior walls of the cabinet and configured to store food stuffs and a first door configured to open and close the first storage chamber by rotating about a first rotational axis. The refrigerator further includes a second storage chamber that is smaller than the first storage chamber defined at a side of the first door, and that is configured to enable access to food stuffs while the first door remains closed. In addition, the refrigerator includes a second door, located in a predetermined portion of the first door, configured to open and close the second storage chamber by rotating a second rotational axis, wherein a rotation direction of the second door is identical to the rotation direction of the first door, and the first rotational axis is parallel to the second rotational axis.

Implementations may include one or more of the following features. For example, the refrigerator further includes a first rotational shaft coupled to the first door and configured to establish the first rotational axis and a second rotational shaft coupled to the second door and configured to establish the second rotational axis. The refrigerator further includes a connection member configured to connect the first rotational shaft to the cabinet.

In some examples, a width of the second door is substantially identical to a width of the first door. The first rotational axis and the second rotational axis are substantially same.

In yet another aspect, a refrigerator includes a cabinet configured to define an exterior boundary of the refrigerator with at least one opening therein. The refrigerator also includes a first storage chamber defined by interior walls of the cabinet and configured to store food stuffs and a first door configured to open and close the first storage chamber by rotating about a rotational axis. The refrigerator further includes a second storage chamber that is smaller than the first storage chamber defined at a side of the first door, and that is configured to enable access to food stuffs while the first door remains closed and a second door, located in a predetermined portion of the first door, configured to open and close the second storage chamber by rotating the rotational axis or substantially same rotational axis of the first door, wherein a rotation direction of the second door is identical to the rotation direction of the first door. In addition, the refrigerator includes a first connection member is configured to connect the first door to the cabinet and a second connection member is connected to the second door to the first door.

Implementations may include one or more of the following features. For example, The second connection member comprises a hinge.

In a further aspect, a refrigerator includes a cabinet configured to define an exterior boundary of the refrigerator with at least one opening therein and the refrigerator also includes a first storage chamber defined by interior walls of the cabinet and configured to store food stuffs and a first door configured to open and close the first storage chamber by rotating about a plurality of first rotational axes. The refrigerator further includes a second storage chamber that is smaller than the first storage chamber defined at a side of the first door, and that is configured to enable access to food stuffs while the first door remains closed. In addition, the refrigerator includes a second door, located in a predetermined portion of the first door, configured to open and close the second storage chamber by rotating a plurality second rotational axes, wherein the first door and second door have at least one identical rotational axis.

Implementations may include one or more of the following features. For example, the plurality of rotational axis includes a first rotational axis positioned at a left side of the first door and second door and a second rotational axis positioned at a right side of the first door and the second door. The first rotational axis configured to open and close the first door and the second door at a identical direction. The second door includes a recess configured to be used as a door handle and configured to open the second door in more than one rotation directions.

It is to be understood that both the foregoing general description and the following detailed description are exemplary and explanatory.

DETAILED DESCRIPTION

Reference will now be made in detail to various implementations of the present technology, examples of which are illustrated in the accompanying drawings. Wherever possible, the same reference numbers will be used throughout the drawings to refer to the same or like parts.

As follows, a refrigerator according to an exemplary implementation will be described in reference to the accompanying drawings.

Figure 1:
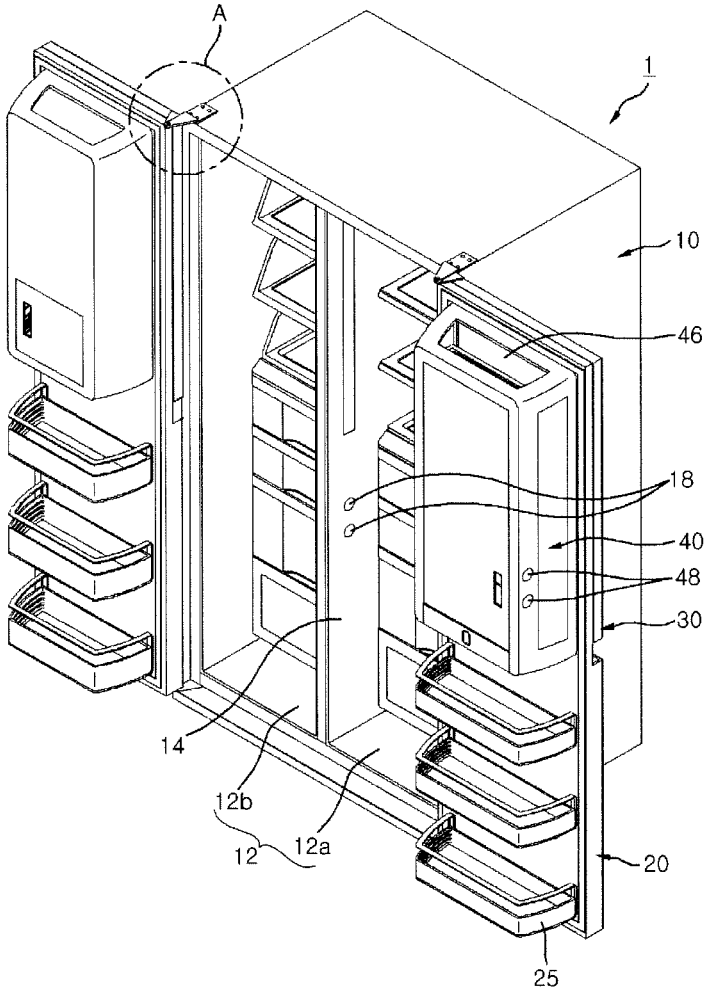
FIG. 1 is a view illustrating a refrigerator in a state of a first storage chamber being opened.

In reference to FIG. 1, an overall structure of the refrigerator will be described. A side by side type refrigerator is embodied to describe the present disclosure as an example.

A first storage chamber 12 is defined in a cabinet 10 of the refrigerator 1 to preserve food stuffs therein. The first storage chamber 12 may include a freezer chamber 12*b* and a refrigerator chamber 12*a*. The freezer chamber 12*b* and the refrigerator chamber 12*a* may be arranged horizontally, that is, side by side.

A first door 20 is defined in a front surface of the cabinet 10 to selectively open and close the first storage chamber 12. A second storage chamber 40 is defined in the first door 20 to preserve food stuffs therein, and the second chamber 40 is selectively opened and closed by a second door 30.

Each of the above configurations will be described in detail as follows.

The first storage chamber 12 defined in the cabinet 10 of the refrigerator 1 is partitioned into the freezer chamber 12*b* and the refrigerator chamber 12*a* by a partition wall 14. Here, at least one shelf and drawer may be installed in the first storage chamber 12.

The second storage chamber 40 is defined in the first door 20, and it has a predetermined space to preserve food stuffs. The second storage chamber 40 is configured to surround the predetermined space. That is, the second storage chamber 40 has the predetermined space positioned inside of the first door 20 and the second chamber 40 is accessible from an outside of the first door 20. In this implementation, the second storage chamber 40 is accessible through an inside of the first door 20. The second storage chamber 40 is also accessible via a second door 30 coupled to the outer surface of the first door 20. Another type of storage space, for example, a door basket 25 may be defined in the inside of the first door 20, different from the second storage chamber 40. The door basket 25 is accessible from the inner side of the first door 20. In this implementation, the door basket 25 is not accessible via the second door 30, and therefore, the door basket 25 may be accessible after the first door 20 is opened.

In some examples, the second storage chamber 40 is typically a predetermined surrounded space and it may include a structure capable of receiving cold air. The second storage chamber 40 may include a first communication part 46 in communication with the first storage chamber 12 such that cold air of the first storage chamber 12 is supplied to the second storage chamber 40. To supply the cold air to the second storage chamber 40, a fan may positioned around the first communication part 40. In this implementation, the first communication part 46 may block supplying the cold air to the second storage chamber 40 when a temperature in the second storage chamber 40 is determined to be lower than a predetermined temperature. A second communication part 48, in direct communication with an end of a cold air duct 18 positioned on the partition wall 14 of the cabinet 10, may be defined in the second storage chamber 40. The second communication part 48 defines at least one passage that the cold air passes through.

Figure 2:
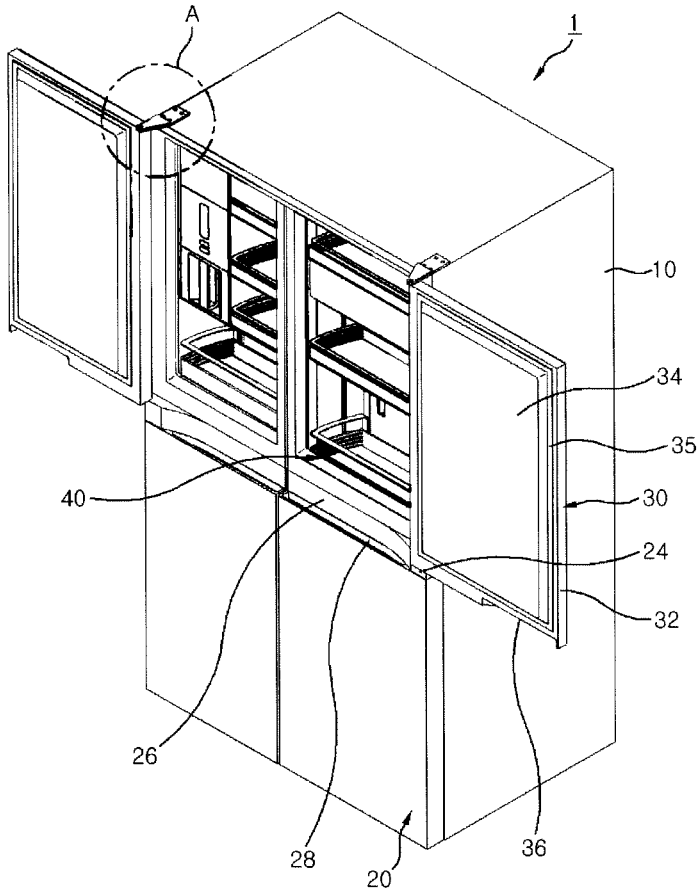
FIG. 2 is a view illustrating the refrigerator in a state of a second storage chamber being opened.

In reference to FIGS. 2 and 3, the first door and the second door will be described in detail.

The first door 20 includes a securing part 21 recessed toward the cabinet 10 and the second door 30 may be secured in the securing part 21. A step 29 stepped toward the cabinet 10 is defined in a predetermined portion of the first door 20, for example, approximately a middle portion of the first door in FIGS. 2 and 3.

The appearance of the second door 30 may be corresponding to the appearance of the first door 20, although it may be otherwise configured. In some examples, the width of the second door 30 may be substantially identical to the width of the first door 20 and the height of the second door 30 may be changeable. And, the thickness of the second door 30 may be identical to the thickness of the securing part 21. In this implementation, although the position or the height of the second door 30 defined in a predetermined portion of the first door 20 is changed or adjusted, a user recognizes the second door 30 as the first door 20 itself or a part of the first door 20, such that beauty of the refrigerator 1 may not be damaged.

In the implementation, a first recess 26 which is recessed inward, may be located in a predetermined portion of the first door 20, for example, between a lower surface of the second door 30 and a coupling part 24 that is ratably coupled to the first door. A second recess 28 recessed downward from the first recess 26 may be located in the first door 20. A third recess 36 recessed upward from a lower surface of the second door 30, which is adjacent to the first recess 26, may be located in the second door 30. This configuration allows the second and third recesses 28 and 36 to function as handles for the first and second doors, respectively, and thus auxiliary handles do not needed in the first and second doors 20 and 30.

A projection part 34, projected upward, is defined in the second door 30 and a gasket 35 may be coupled to a circumstance of the projection part 34 for sealing the second door 30.

Figure 3:
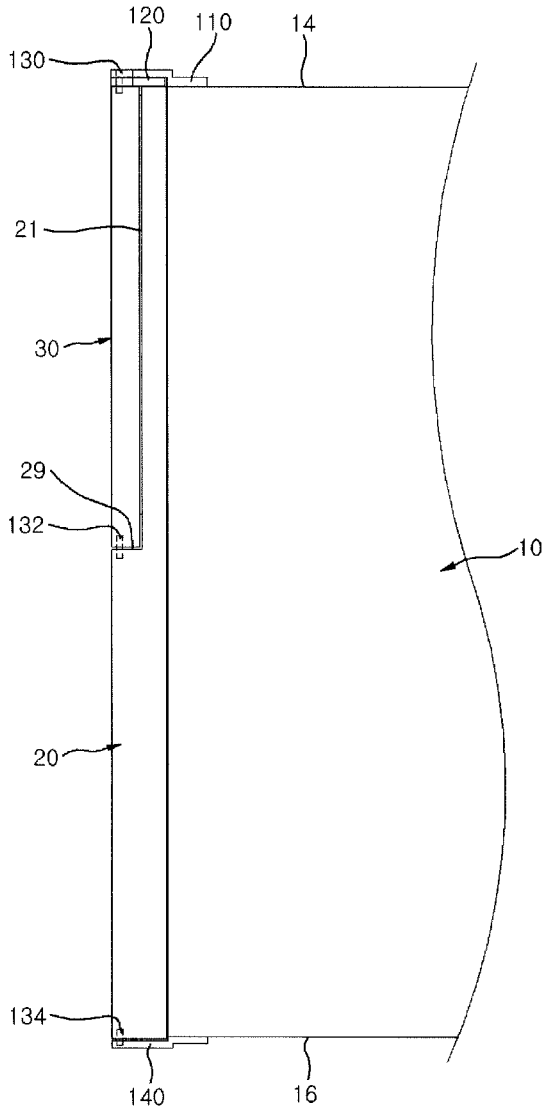
FIG. 3 is a longitudinal-sectional view of FIG. 1.

As shown in FIG. 3, a coupling and rotation structure of the first door and the second door will be described. As an example, the second door 30 is secured in the securing part 21 of the first door 20.

The first door 20 selectively opens and closes the first storage chamber 12, and the second door 30 selectively opens and closes the second storage chamber 40 defined in the first door 20. In this implementation, a rotational direction of the first door 20 is identical to that of the second door 30. For example, the first door 20 is rotatable with respect to a vertical shaft in the conventional refrigerator and the second door 30 is also rotatable with respect to the vertical shaft.

If the rotational direction of the first door 20 is identical to that of the second door 30, a rotational radius of the conventional refrigerator 1 may be determined based on the first door 20 for opening and closing the first storage chamber. As a result, the user should arrange the refrigerator without any obstacles placed in the rotational radius of the first door 20. Also, if the rotational direction of the second door 30 is identical to that of the first door, it may be possible to increase the size of the second storage chamber defined in the first door 20. Also, if the rotational directions of the first and second doors 20 and 30 are identical, the sealing structure between the first and second doors 20 and 30 may be applicable to the sealing structure between the cabinet 10 and the first door 20.

In this implementation, the rotational shaft of the first door 20 is parallel to the rotational shaft of the second door 30. The rotational shafts of the first and second doors 20 and 30 are located on the same line, such that only a single rotational shaft may be used to simplify an assembly structure of the refrigerator 1. Alternatively, in one implementation, the rotational shafts of the first and second doors 20 and 30 may be located at opposite side. For example, the first rotational shaft for the first door 20 is located at a right side of the refrigerator while the second rotational shaft for the second door 30 is located at a left side in case that the refrigerator 1 is not the side by side type. Therefore, the user can open the first door 20 in a first rotation direction in which the first door 20 rotates with respect to the rotational shaft in the right side. Also, the user can open the second door 30 in a second rotation direction which is opposite of the first rotation direction in which the second door 30 rotates with respect to the rotational shaft located in the left side.

Furthermore, the first door 20 and the second door 30 can share the rotational shafts so that the user can open the first door 20 and the second door 30 in both directions. For example, if the user pull the right side of the first door 20, the first door 20 is rotated with respect to the rotational shaft located in the left side, and if the user pull the left side of the second door 30, the second door 30 is rotated with respect to the rotational shaft located in the right side. In this implementation, the rotational shafts located in the right side and the left side, respectively can be shared by the first door 20 and the second door 30, the user can open the first door 30 and the door any rotational directions whatever the user wants. In this case, the second and third recesses 28 and 36 employed as handles as shown in FIG. 3 may be recessed from the left side to entirely or left and right sides.

Figure 4:
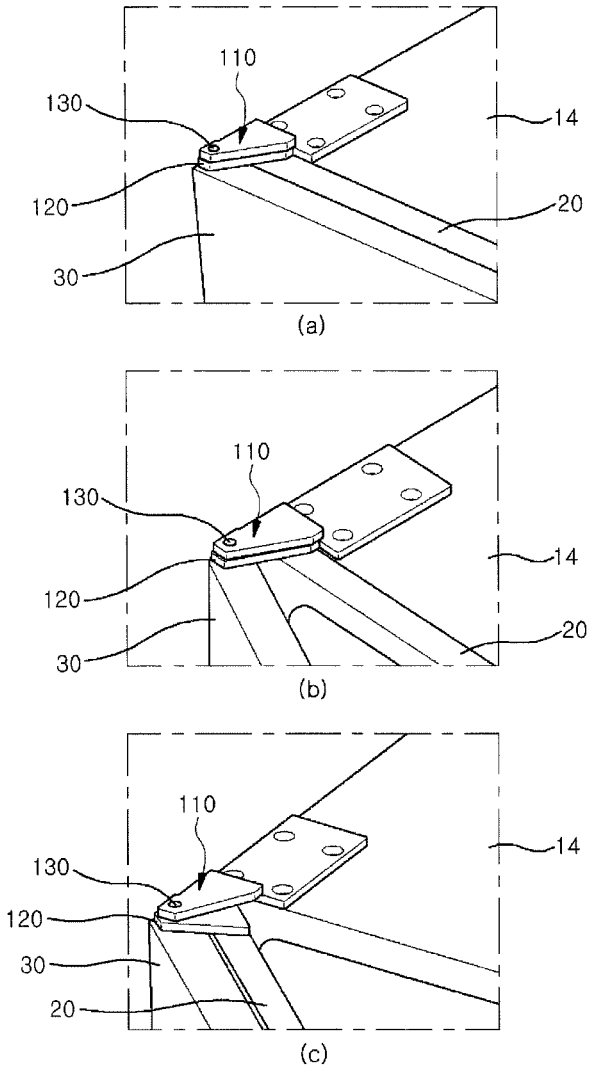
FIG. 4 is a diagram illustrating a first door and a second door of the refrigerator, in a state of being opened.

Referring to FIG. 4, an upper structure to selectively open the first door 20 and the second door 30 includes a first connection member 110, a second connection member 120 and a rotational shaft 130.

An end of a first connection member 110 is coupled to an upper surface 14 of the cabinet 10 and the other end of the connection member 110 is connected to an upper surface of the second door 30 through the medium of the rotational shaft 130. An end of a second connection member 120 is coupled to an upper surface of the first door 20 and the other end of the second connection member 120 is connected to the upper surface of the second door 30 through the medium of the same upper rotational shaft 130. In this implementation, the second connection member 120 may be located below the first connection member 110. As a result, the upper rotational shaft 130 is employed as a common rotational shaft for the first and second doors 20 and 30.

Referring to FIG. 3, a rotational shaft 132 for a lower portion of the second door 30 to open and close is defined in a lower surface of the second door 30. The lower rotational shaft 132 is connected to the coupling part 24 as shown in FIG. 2. The coupling part 24 may be defined in the securing part 21 of the first door 20. A rotational shaft 134 for a lower portion of the first door 20 is defined in a lower surface of the first door 20 and the lower rotational shaft 134 is connected to a lower surface of the cabinet 10 by a third connection member 140, as shown in FIG. 4.

FIG. 4(*a*) shows a configuration of the upper structure in a close state of the first and second doors 20 and 30.

FIG. 4(*b*) shows a configuration of the upper structure in a open state of the second door 30. A user can open the second door 30 to approach to the second storage chamber 40 defined in the first door 20. If the user pulls only the second door 30 in a forward direction by using the handle 36 as shown in FIG. 1, the second door 30 is rotated with respect to the common upper rotational shaft 130 and the lower rotational shaft 132 as shown in FIG. 3, while the first door 20 not opened, and the second storage chamber 40 is thus opened.

Figure 5:
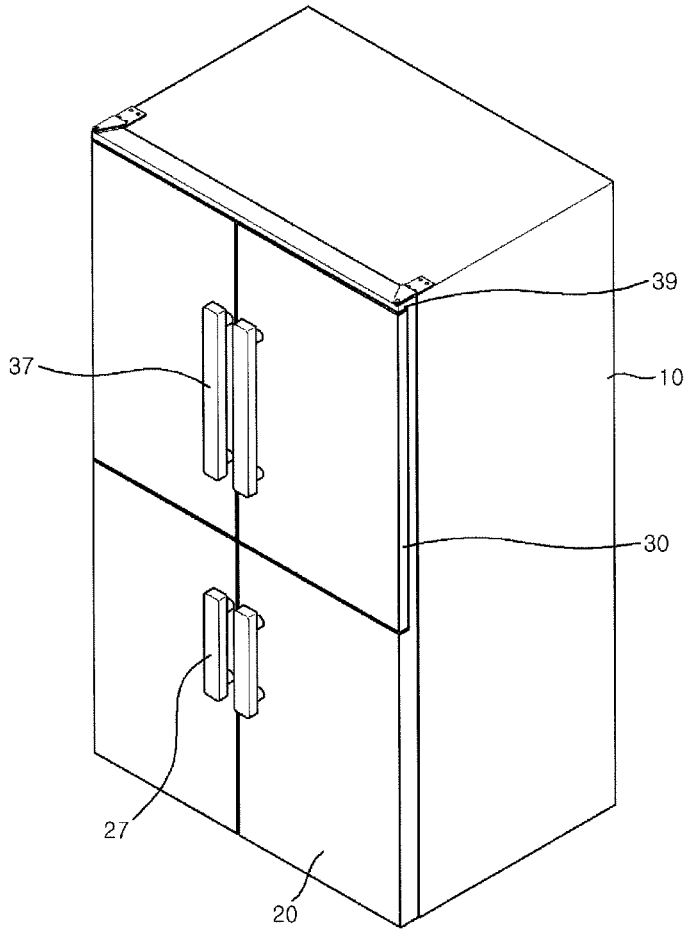
FIG. 5 is a view illustrating a refrigerator.

FIG. 4(*c*) shows a configuration of the upper structure in a open state of the first door 20. The user can open the first door 20 to approach to the first storage chamber 12. If the user pulls the first door 20 forward by using the handle 28 as shown in FIG. 1, the first and second doors are rotated together with respect to the common upper rotational shaft 130 and the lower first door rotational shaft 134 as shown in FIG. 3 and then the first storage chamber 12 is opened. In this implementation, the second connection member 120 is rotated such that the first and the second doors 20 and 30 can rotate together. As an example, FIG. 5 shows a handle 27 for opening and closing the first door 20 and a handle 37 for opening and closing the second door positioned on outer surfaces of the first and second doors 20 and 30, respectively. As mentioned in the description, a recess used as a handle may be defined in the first and second doors, respectively.

Figure 6:
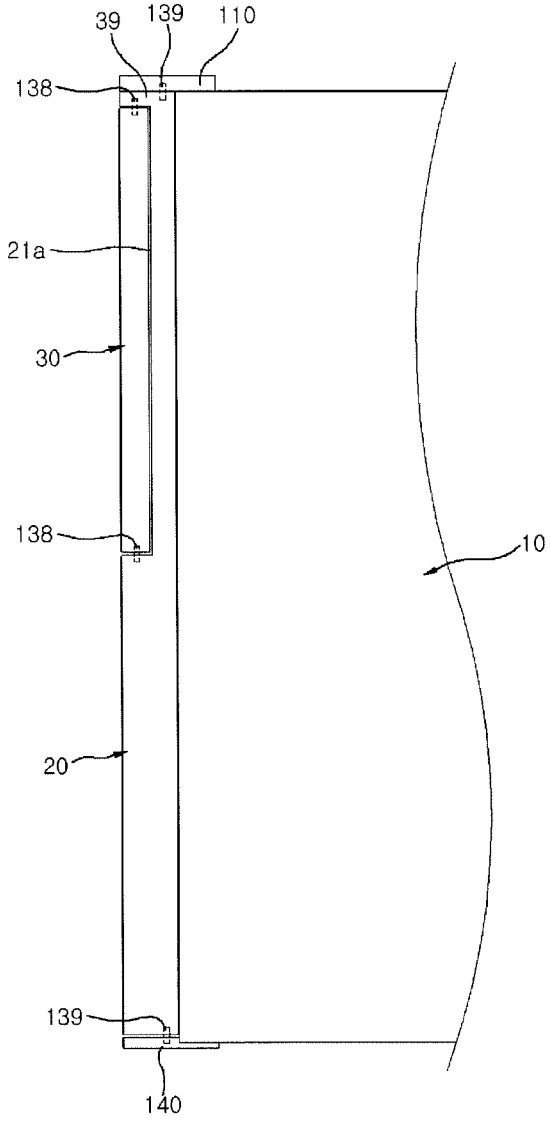
FIG. 6 is a longitudinal-sectional view.

Referring to FIG. 6, this implementation is similar to the previous implementation for example, two door structure, but, the structure to selectively open the first door 20 and the second door 30 is modified. For example, appearance of the securing part 21*a* of the first door 20 is modified. As shown in FIG. 3, in the previous implementation, an upper portion of the securing part 21 of the first door 20 is exposed such that the upper surfaces of the first and second doors 20 and 30 are at an identical level. In this implementation, a projection part 39 is defined in an upper portion of the first door 20 to rotatably couple the upper surface of the second door 30 to a lower surface of the projection part 39. As a result, the upper surface of the second door 20 is located under the projection part 39 of the first door 20.

As shown in FIG. 6, a pair of rotational shafts for the first door 139 may be defined in the first door 20 and a pair of rotational shafts for the second door 138 may be defined in the second door 30. The first door rotational shaft 139 and the second door rotational shaft 138 are parallel but offset.

In some implementations, the first door rotational shaft 139 and the second door rotational shaft 138 may be located at the same shaft line. In this case, the upper rotational shaft of the first door 139 and the upper rotational shaft of the second door 138 may be on the same rotational shaft line.

In case of the door structure as shown FIG. 6, a hinge structure may be installed in inner surfaces of the first and second doors 20 and 30, instead of the rotational shaft 138 of the second door 30.

Figure 7:
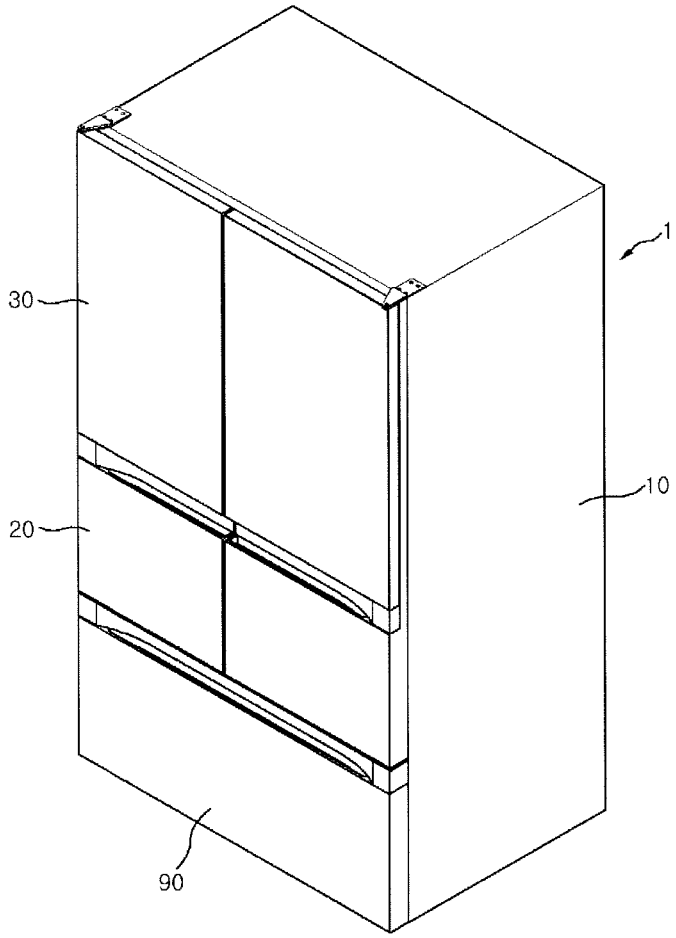
FIG. 7 is a view illustrating a refrigerator.

The side by side type refrigerator is presented to describe the implementations and so, the present disclosure is not limited thereto. The present disclosure is applicable to a top freezer type having a freezer chamber placed on a refrigerator chamber or a bottom freezer type having a freezer chamber arranged under a refrigerator chamber. Referring to FIG. 7, the present disclosure may be applicable to a refrigerator having the refrigerator chamber arranged in the upper portion of the cabinet and the freezer chamber defined in the lower portion of the cabinet. In this implementation, the first door 20 selectively opens and closes the refrigerator chamber and the second selectively opens and closes a portion of the refrigerator chamber, for example, a home bar. In this implementation, a sliding door 90 is located below the first door 20 to selectively open and close the freezer chamber.

Further, the present disclosure may be applicable to a refrigerator having a closable freezer chamber that is a drawer type and a refrigerator chamber having a pair of doors opened and closed with respect to a pair of vertical shafts.

In addition, the appearance of the first door is corresponding to that of the second door. For example, the width of the first door is identical to the width of the second door and the length of the second door is smaller than the length of the first door. Since the width of the first door 20 and the second door 30 is identical, the rotation width of the first door 20 and the second door 30 also may be identical.

Further, the present disclosure may be applicable to a case in that both of the width and the height of the second door may be smaller than those of the first door.

It will be understood that various modifications may be made without departing from the spirit and scope of the claims. For example, advantageous results still could be achieved if steps of the disclosed techniques were performed in a different order and/or if components in the disclosed systems were combined in a different manner and/or replaced or supplemented by other components. Accordingly, other implementations are within the scope of the following claims.

What is claimed is:

1. A refrigerator comprising:

a cabinet;

a first storage chamber defined within the cabinet;

a first door configured to open and close at least a portion of the first storage chamber by rotating;

a first hinge that attaches an upper portion of the first door;

a second hinge that attaches a lower portion of the first door to a lower portion of the cabinet;

a second storage chamber that is smaller than the first storage chamber, that is defined at a side of the first door, that is configured to move with the first door when the first door rotates between opened and closed positions, and that is located in the first storage chamber when the first door is oriented in a closed position;

a second door that is configured to open and close the second storage chamber by rotating in a same direction as the first door, that enables access to the second storage chamber when the first door is oriented in a closed position, that spans an entire width of the first door, and that has a height that is less than a height of the first door;

a third hinge that attaches an upper portion of the second door and that is positioned adjacent to the first hinge; and a fourth hinge that attaches a lower portion of the second door to the first door at a location of the first door that is between the first and second hinges, wherein the first hinge and the third hinge are part of a single hinge assembly, and wherein the single hinge assembly comprises a single rotational shaft that is coupled to the first door and the second door and that establishes a single rotational axis for the first door and the second door, wherein the single hinge assembly comprises:

a first connection member in which a first end of the first connection member is coupled to an upper surface of the cabinet and a second end of the first connection member is connected to an upper surface of the second door through the single rotational shaft; and a second connection member in which a first end of the second connection member is coupled to an upper surface of the first door and a second end of the second connection member is connected to the upper surface of the second door through the single rotational shaft, wherein the second connection member is located below the first connection member.

2. The refrigerator of claim 1, further comprising:

a freezer chamber located below the first storage chamber; and a third door configured to open and close at least a portion of the freezer chamber.

3. The refrigerator of claim 1, wherein the second storage chamber comprises a home bar.

4. The refrigerator of claim 1, wherein the first door comprises a recess that is defined at the first door and that provides a handle that enables a user to pull open the first door.

5. The refrigerator of claim 1, wherein the second door comprises a recess that is defined at the second door and that provides a handle that enables a user to pull open the second door.

6. The refrigerator of claim 1, wherein a width of the second door is substantially identical to a width of the first door.

7. The refrigerator of claim 1, wherein the second door aligns with an uppermost edge of the first door when the second door is oriented in a closed position.

8. The refrigerator of claim 1, further comprising a housing that is configured to connect to the first door and define the second storage chamber provided at the side of the first door.

9. The refrigerator of claim 1, wherein the height of the second door is about half of the height of the first door.

* * * * *